US008165482B2

(12) United States Patent
Hata

(10) Patent No.: US 8,165,482 B2
(45) Date of Patent: Apr. 24, 2012

(54) IMAGE FORMING APPARATUS WITH FAILURE DETECTION AND CONTROL METHOD THEREFOR

(75) Inventor: Yousuke Hata, Matsudo (JP)

(73) Assignee: Canon Kabushiki Kaisha (JP)

( * ) Notice: Subject to any disclaimer, the term of this patent is extended or adjusted under 35 U.S.C. 154(b) by 313 days.

(21) Appl. No.: 12/604,941

(22) Filed: Oct. 23, 2009

(65) Prior Publication Data

US 2010/0104297 A1 Apr. 29, 2010

(30) Foreign Application Priority Data

Oct. 24, 2008 (JP) ..... 2008-274172

(51) Int. Cl.
*G03G 15/20* (2006.01)

(52) U.S. Cl. ..... 399/33

(58) Field of Classification Search ..... 399/33, 399/67, 69

See application file for complete search history.

(56) References Cited

U.S. PATENT DOCUMENTS

2009/0003868 A1 * 1/2009 Namiki et al. ..... 399/69

FOREIGN PATENT DOCUMENTS

| | | | | |
|---|---|---|---|---|
| JP | 58-105180 | A | | 6/1983 |
| JP | 2006259185 | A | * | 9/2006 |
| JP | 2007327989 | A | * | 12/2007 |
| JP | 2008209718 | A | * | 9/2008 |

* cited by examiner

*Primary Examiner* — Quana M Grainger

(74) *Attorney, Agent, or Firm* — Rossi, Kimms & McDowell LLP

(57) ABSTRACT

An image forming apparatus that enables to continue an operation so that electric power consumption does not exceed a power supply capacity even if an electric current sensor breaks down. A temperature detection unit detects a temperature of a fixing unit that fixes a developed image transferred to sheet material. A failure detection unit detects whether an electric current detection unit that detects an electric current from a commercial power source breaks down. A control unit determines a fixing electric power supplied to the fixing unit based on the temperature detected by the temperature detection unit; and changes the determined fixing electric power so that the electric power consumption does not exceed a limit value and so as not to exceed a predetermined electric power without using an output of the electric current detection unit when the failure detection unit detects a failure of the electric current detection unit.

5 Claims, 10 Drawing Sheets

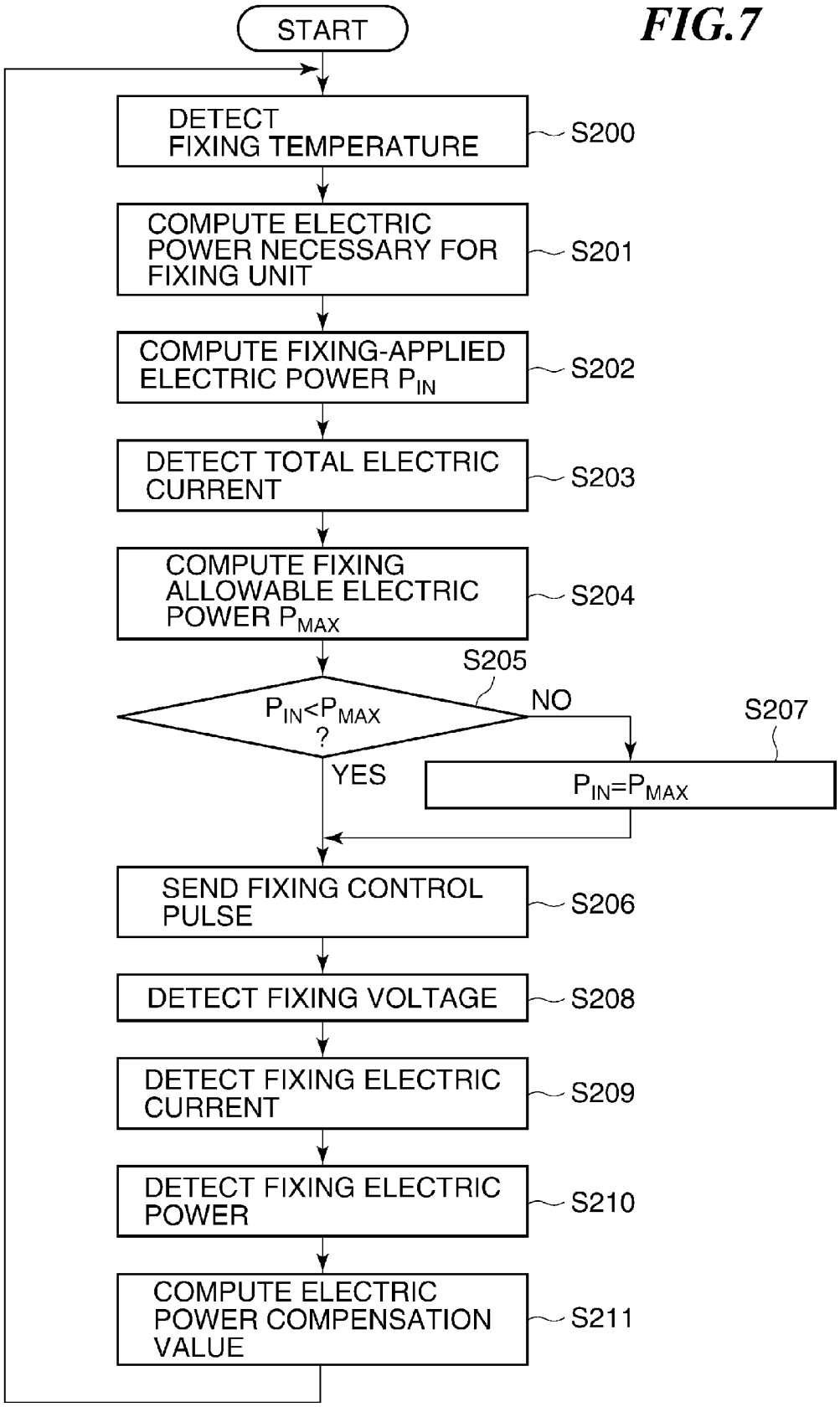
FIG.7
START
DETECT FIXING TEMPERATURE
S200
COMPUTE ELECTRIC POWER NECESSARY FOR FIXING UNIT
S201
COMPUTE FIXING-APPLIED ELECTRIC POWER $P_{IN}$
S202
DETECT TOTAL ELECTRIC CURRENT
S203
COMPUTE FIXING ALLOWABLE ELECTRIC POWER $P_{MAX}$
S204
S205
$P_{IN}<P_{MAX}$ ?
NO
YES
S207
$P_{IN}=P_{MAX}$
SEND FIXING CONTROL PULSE
S206
DETECT FIXING VOLTAGE
S208
DETECT FIXING ELECTRIC CURRENT
S209
DETECT FIXING ELECTRIC POWER
S210
COMPUTE ELECTRIC POWER COMPENSATION VALUE
S211

IMAGE FORMING APPARATUS WITH FAILURE DETECTION AND CONTROL METHOD THEREFOR

BACKGROUND OF THE INVENTION

1. Field of the Invention

The present invention relates to an image forming apparatus that includes a fixing unit, and a control method therefor.

2. Description of the Related Art

The image forming apparatus using an electro photography method develops an electrostatic latent image, which is formed on a photo conductor by laser radiation, by development agent supplied from a development unit to visualize as an image of the development agent, transfers the image of the development agent to a recording paper, and fixes it by a fixing unit. In order to fuse the development agent on the record paper and to fix it to the recording paper, the fixing unit is heated to high temperature. As a heat source for that, an induction coil, a halogen heater, etc. are used. The electric energy applied to the fixing unit is usually controlled based on a temperature value detected by a detector such as a thermistor so that the fixing unit keeps a predetermined fixing temperature at about 200 degrees centigrade.

Moreover, in order to secure a fixing ability during a print operation, it is necessary to apply an electric power to compensate a heating value lost by passing the recording paper. Therefore, the electric power required by the fixing unit to secure the fixing ability increases as the number of the recording papers passing through the fixing unit per a unit time increases with improvement in the speed of the image forming apparatus. In a color image forming apparatus, since the total amount of the development agent applied onto the recording paper in an overlapped fashion increases, the more electric energy is required to fuse and fix. The image forming apparatus is provided with various parts as loads that consume the electric power such as a motor for conveying a paper and a semiconductor laser for exposing the photo conductor, besides the fixing unit.

However, a usable electric power is restricted by an environment of an electric power source to which the image forming apparatus is connected. For example, the maximum usable electric power of a general plug socket in Japan is 100V/15 A, i.e., 1500 W.

Therefore, conventionally, the maximum electric power consumptions of the respective loads including the fixing unit have been estimated, and the apparatus is designed so that the sum total of the maximum electric power consumptions does not exceed a power supply capacity (for example, 1500 W). Although this design method is based on the sum total of the maximum electric power consumptions of the respective loads, the electric power consumption of the image forming apparatus becomes lower than the power supply capacity during an actual operation. Therefore, the usable electric power is not used efficiently.

In contrast to such a method, Japanese laid open patent publication (Kokai) No. S58-105180 (JP S58-105180A) discloses a technique to control a possible electric power supplied to the fixing unit based on a permissible maximum electric power that is determined in consideration of the power supply capacity. With this technique, an electric current sensor that detects electric current amount flowing into the image forming apparatus is provided, and a total electric current consumption flowing into the image forming apparatus is detected. A temperature of the fixing unit is detected and is compared with a predetermined value, and the electric current supplied to a heat source heater is controlled based on the compared output. And then, the electric power supplied to the fixing unit is controlled so that the total electric power consumption of the image forming apparatus is not larger than the power supply capacity.

However, the technique disclosed in Japanese laid open patent publication (Kokai) No. S58-105180 (JP S58-105180A) has the following disadvantages. That is, when the electric current sensor breaks down and an improper detection value thereof is used to control, a fixing temperature may excessively rise due to an oversupplying of an electric power to the fixing unit, or a fixing temperature may fall due to an insufficient electric power. This causes problems such as an output of an abnormal image due to poor fixing and an increase in a down time of the apparatus, as a result.

SUMMARY OF THE INVENTION

In view of the above mentioned conventional problems, the present invention provides an image forming apparatus and a control method therefor that include the following functions.

(1) To prevent a runaway operation of the image forming apparatus caused by a total electric power control based on an improper electric current value.

(2) To continue an operation so that the electric power consumption of the image forming apparatus does not exceed the power supply capacity even if the electric current sensor breaks down.

Accordingly, a first aspect of the present invention provides an image forming apparatus that operates by an electric power from a commercial power source, comprising a fixing unit adapted to fix a developed image transferred to sheet material, a temperature detection unit adapted to detect a temperature of the fixing unit, a control unit adapted to determine a fixing electric power supplied to the fixing unit based on the temperature detected by the temperature detection unit, an electric current detection unit adapted to detect an electric current flowing into the image forming apparatus from the commercial power source, and a failure detection unit adapted to determine whether the electric current detection unit breaks down, wherein the control unit changes the determined fixing electric power so that the electric power consumption determined based on the electric current detected by the electric current detection unit does not exceed a limit value, and wherein the control unit changes the determined fixing electric power so as not to exceed a predetermined electric power without using the output of the electric current detection unit when the failure detection unit determines that the electric current detection unit breaks down.

Accordingly, a second aspect of the present invention provides a control method for an image forming apparatus that has a fixing unit for fixing a developed image transferred to sheet material, an electric current detection unit for detecting an electric current flowing into the image forming apparatus from a commercial power source, a temperature detection unit for detecting a temperature of the fixing unit, and a control unit for controlling a fixing electric power supplied to the fixing unit, the method comprising a first determination step of determining the fixing electric power supplied to the fixing unit based on the temperature of the fixing unit detected by the temperature detection unit, a changing step of changing the fixing electric power determined in the first determination step so that the electric power consumption determined based on the electric current detected by the electric current detection unit does not exceed a limit value, a failure detection step of determining whether the electric current detection unit breaks down, a second determination step of prohibiting the execution of the changing step, and of determining the fixing electric power so that the fixing electric power does not exceed a predetermined electric power that is lower than the limit value when it is determined that the electric current detection unit breaks down in the failure detection step.

According to the present invention, since the total electric power control stops when a detected electric current value is out of a predetermined range, a runaway operation of the image forming apparatus caused by the total electric power control based on an improper electric current value can be prevented.

Further, since a mode is changed so that the electric power consumption of the image forming apparatus does not exceed the predetermined value even if the total electric power control stops, the operation of the image forming apparatus can continue properly.

The features and advantages of the invention will become more apparent from the following detailed description taken in conjunction with the accompanying drawings.

BRIEF DESCRIPTION OF THE DRAWINGS

FIG. 7 is a flowchart showing a total electric power control using an electric current sensor according to the embodiment.

DESCRIPTION OF THE EMBODIMENTS

Hereafter, embodiments according to the present invention will be described in detail with reference to the drawings.

Figure 1:
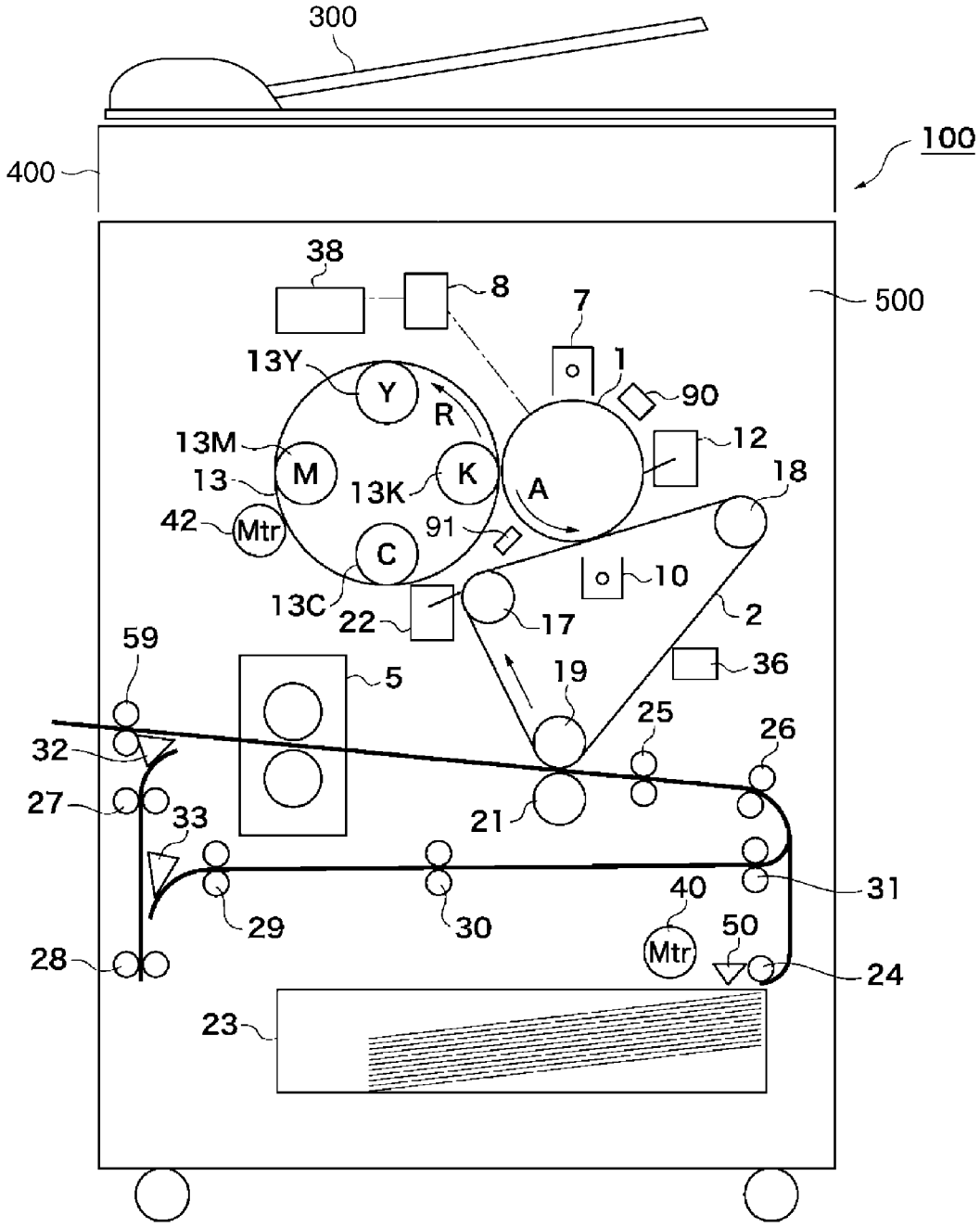
FIG. 1 is a sectional view schematically showing an entire configuration of an image forming apparatus according to an embodiment of the present invention.

FIG. 1 is a sectional view schematically showing an entire configuration of a color printer as an image forming apparatus according to an embodiment of the present invention.

The image forming apparatus 100 is provided with an ADF (automatic document feeder) 300 that sets an original to a reading position automatically, a reader unit 400 that reads an image of the set original to output an image signal, and an image forming unit 500.

In the image forming unit 500, an exposure device 8 that consists of a laser scanner, an image control unit 38 that controls the exposure device 8 based on the image signal outputted from the reader unit 400, and a photoconductive drum 1 as an image bearing member are arranged. The photoconductive drum 1 can be rotated in the direction of an arrow A by a motor that is not shown in the figure. Around the photoconductive drum 1, a pre-exposure lamp 90, a primary electrostatic charger 7, a rotating development unit 13, a concentration sensor 91, a transfer device 10, and a cleaning device 12 are arranged.

The rotating development unit 13 includes development devices 13Y, 13M, 13C, and 13K of four colors for full color development. The rotating development unit 13 is rotated by a drive motor 42 that consists of a stepping motor, for example.

The development devices 13Y, 13M, 13C, and 13K develop a latent image on the photoconductive drum 1 with toner of Y (yellow), toner of M (magenta), toner of C (cyan), and toner of K (black), respectively.

Toner images (developed images) of the respective colors developed on the photoconductive drum 1 are sequentially transferred onto a belt 2 as an intermediate transfer member by the transfer device 10, and as a result, the toner images of the four colors are stacked. The belt 2 is looped over rollers 17, 18, and 19 while keeping tension. Among these, the roller 17 functions as a driving roller that is connected to a driving source (not shown) to drive the belt 2, and the roller 18 functions as a tension roller that adjusts the tension of the belt 2. Further, the roller 19 functions as a backup roller of a transfer roller as a secondary transfer device 21.

At the opposite side of the roller 17 across the belt 2, a belt cleaner 22 that can contact to or separate from the belt 2 is arranged. Remained toner on the belt 2 after the transfer is scraped by the cleaner blade included in the belt cleaner 22.

A recording paper (a sheet material) arranged in a recording paper cassette 23 can be pulled up to the position to contact with a pickup roller 24 by an operation of a motor 40. The recording paper pulled out from the recording paper cassette 23 to a conveyance way by the pickup roller 24 is fed to a nip position, i.e., the contact position of the secondary transfer device 21 and the belt 2 by a pair of rollers 25 and 26. The toner image formed on the belt 2 is transferred on the recording paper at the nip position, and is fixed with heat by a fixing unit 5. Then, the recording paper on which the toner image is fixed is ejected out of the apparatus through an ejection roller 59.

In double sided formation operation, a flapper 32 changes its position so that the recording paper is conveyed toward a conveying roller 27. After the recording paper is conveyed until the back end of the sheet exceeds a flapper 33 by a conveying roller 28, the conveying roller 28 rotates in reverse. Further, the flapper 33 changes its position so that the recording paper is conveyed toward a conveying roller 29. After that, the recording paper is conveyed by conveying rollers 30 and 31, joins the conveyance pass from the recording paper cassette 23, and is conveyed so that an image is formed on the side opposite to the first side.

In the color printer having the above mentioned configuration, an image is formed as follows. First, a voltage is applied to the primary electrostatic charger 7, and the primary electrostatic charger 7 charges the surface of the photoconductive drum 1 negatively. Then, the exposure device 8 turns ON/OFF a laser beam based on the image signal generated by the image control unit 38, and exposes the charged surface of the photoconductive drum 1. As a result, a latent image is formed on the surface of the photoconductive drum 1.

A developing bias predetermined for each color is applied to a developing roller of the development device 13Y etc. beforehand, and the above mentioned latent image is developed by the toner so as to be visualized as a toner image when the latent image passes the position of the developing roller concerned. The toner image is transferred to the belt 2 by the transfer device 10 and also is transferred to the recording paper by the secondary transfer device 21, and then, is fed into the fixing unit 5. At the time of a full color print, after the toners of four colors are stacked on the belt, they are transferred to the recording paper.

Remained toner on the photoconductive drum 1 is removed and recovered by the cleaning device 12, and finally, the photoconductive drum 1 is uniformly discharged to near 0v by the pre-exposure lamp 90 as a preparation to the next image formation cycle.

Next, an electrical configuration that constitutes the feature of the image forming apparatus according to this embodiment will be described with reference to FIG. 2.

Figure 2:
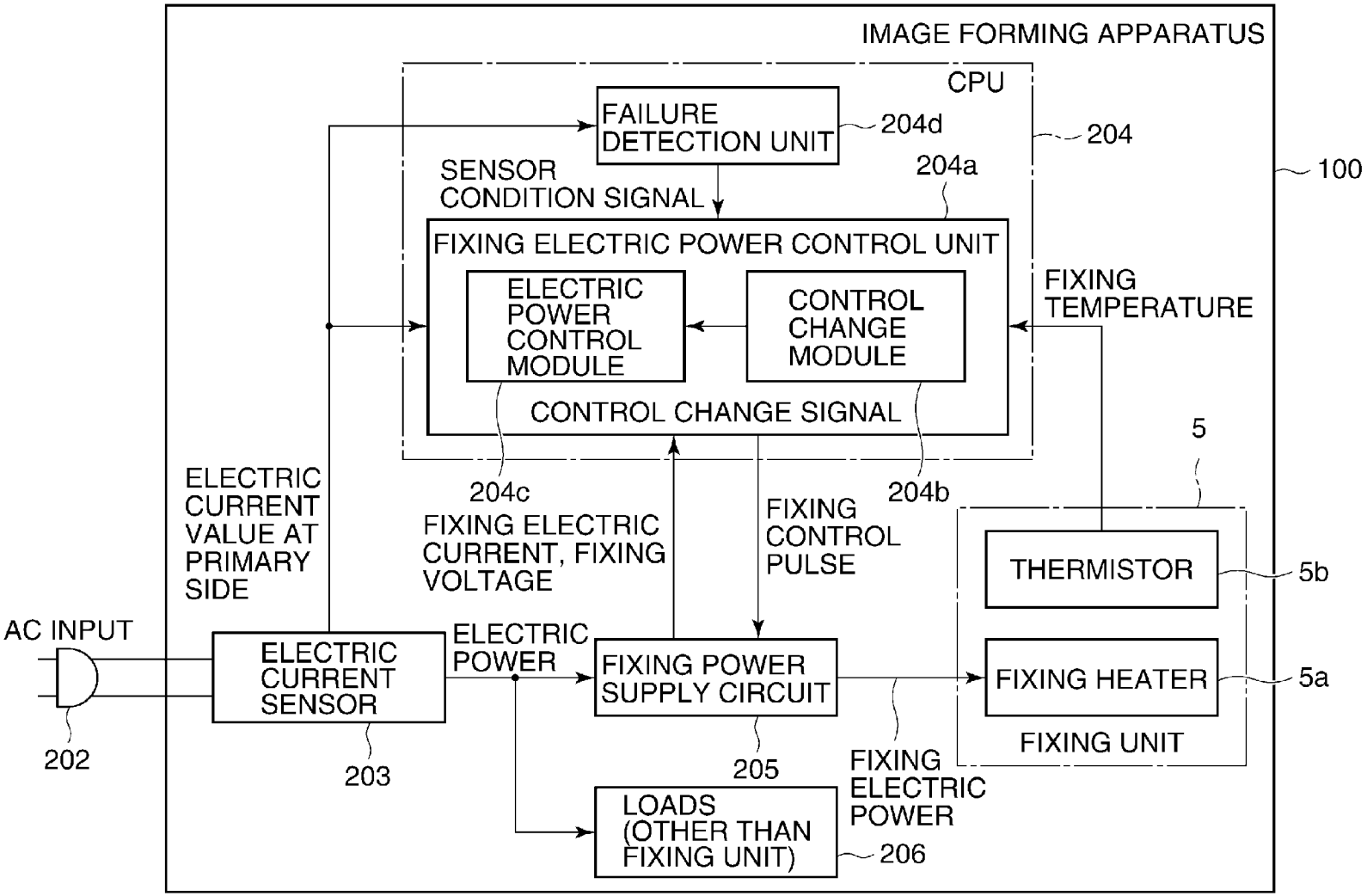
FIG. 2 is a block diagram schematically showing an electrical configuration of the image forming apparatus according to the embodiment.

FIG. 2 is a block diagram schematically showing the electrical configuration of the image forming apparatus according to this embodiment.

Power is supplied to the image forming apparatus 100 in this embodiment from a plug socket of a commercial power source via a power cable 202. The electric power supplied from the commercial power source is supplied to the fixing unit 5 of an induction heating type (IH) via a fixing power supply circuit 205, and to a plurality of loads 206 other than the fixing unit such as a driving motor that conveys the recording paper. An electric current sensor 203 that detects the inputted power source electric current is provided inside the image forming apparatus 100.

The electric current sensor 203 will be described here. There are the following methods for detecting electric current, for example. A first method uses a direct current resistor. A resistor is connected to a power source line in series, and voltages of both ends of the resistor is detected at the time of energization, and an electric current value that flows through the resistor is computed. Although this method is cheap, since a direct current resistance value cannot be made extremely small with respect to the electric current to be detected, a voltage drop generates heat and power loss. A second method uses a current transformer. This method computes the electric current from the voltage induced at a secondary side winding due to electromagnetic induction between a primary side coil and the secondary side winding of the transformer. A third method uses a hall device. This method converges a magnetic flux generated around a line through which the electric current flows, by an iron core, and converts the magnetic flux into voltage by the hall device to compute the electric current.

The fixing unit 5 has a fixing heater 5*a* that is a fixing heat source, and a thermistor 5*b* that detects a temperature (a fixing temperature) of the fixing heater 5*a*. The entire control of the image forming apparatus 100 including electric power control of the fixing unit 5 is performed by a CPU 204. The fixing electric power supply circuit 205 controls fixing electric power supplied to the fixing unit 5 based on a fixing control pulse from the CPU 204. Namely, the CPU 204 has a function as a fixing electric power control unit 204*a*, and the fixing electric power control unit 204*a* takes in respective values of the fixing temperature detected by the thermistor 5*b*, fixing electric current and voltage supplied to the fixing unit 5 from the fixing electric power supply circuit 205, and generates the fixing control pulse based on these values. This will be described as a fixing temperature control with reference to FIG. 3 later.

The CPU 204 is provided with a function of a failure detection unit 204*d* other than the fixing electric power control unit 204*a*. The failure detection unit 204*d* detects a condition (normal/abnormal) of the electric current sensor 203 based on the electric current value detected by the electric current sensor 203 concerned. The fixing electric power control unit 204*a* of the CPU 204 has functions as a control change module 204*b* and an electric power control module 204*c*.

The control change module 204*b* outputs a control change signal according to the condition of the electric current sensor 203 detected by the failure detection unit 204*d*. The electric power control module 204*c* changes the mode of operation of the electric power control of the image forming apparatus according to the control change signal. That is, when the failure detection unit 204*d* determines that the electric current sensor 203 is normal, a first mode in which the fixing electric power is controlled so that a total electric power consumption becomes constant using the electric current sensor 203 is set. When the failure detection unit 204*d* determines that the electric current sensor 203 is abnormal, the mode is shifted to a second mode in which the maximum value of the fixing electric power is determined based on the maximum electric power consumptions consumed by the loads other than the fixing unit. These first and second modes will be described in detail later.

Next, a temperature adjustment control of the fixing unit 5 of the induction heating type (referred to as a fixing temperature control, hereinafter) will be described.

In the image forming apparatus 100 in this embodiment, the fixing temperature is controlled by determining the fixing electric power applied to the fixing unit 5 based on the temperature obtained by the thermistor 5*b*. For example, during a print operation, a target temperature value required for heat fusing is set up, and the fixing electric power required to achieve the temperature is applied.

Figure 3:
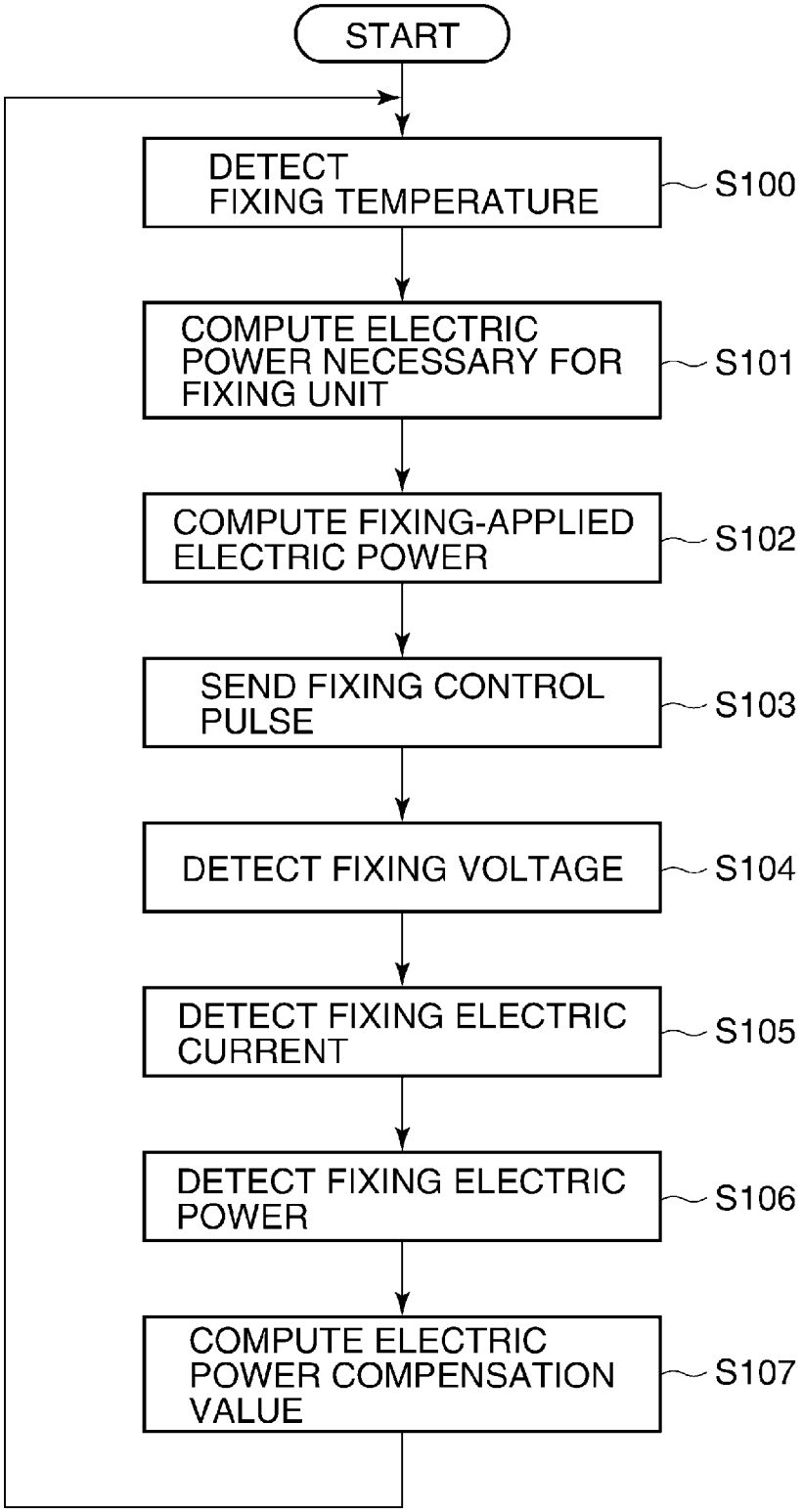
FIG. 3 is a flowchart showing a fixing temperature control according to the embodiment.

Hereinafter, the fixing temperature control will be described with reference to FIG. 3. FIG. 3 is a flowchart showing the fixing temperature control according to this embodiment.

The temperature of the fixing unit 5 is always monitored for proper fixing, and the CPU 204 acquires periodically a fixing temperature $T_{FIX}$ detected by the thermistor 5*b* (step S100). The CPU 204 computes an electric power $P_{SET}$ that should be supplied to the fixing unit 5 based on the target fixing temperature and the acquired fixing temperature $T_{FIX}$ (step S101). Further the CPU 204 computes a fixing-applied electric power $P_{IN}$ based on the sum of an electric power compensation value $P_{AD}$ described later and the fixing electric power $P_{SET}$ (step S102). It should be noted that the electric power compensation value $P_{AD}$ is zero at first.

Then, the CPU 204 sends the fixing control pulse PWM based on the fixing-applied electric power $P_{IN}$ to the fixing electric power supply circuit 205 (step S103). As a result, the fixing power supply circuit 205 that receives the fixing control pulse PWM controls ON/OFF of a switching element that supplies a high frequency electric current to an induction heating coil provided inside the fixing unit 5. This generates the high frequency electric current in the induction heating coil, which generates a magnetic flux in the induction heating coil and heats the fixing roller of the fixing unit 5. At this time, the CPU 204 detects a fixing voltage $V_{FIX}$ and a fixing electric current $I_{FIX}$ that are actually inputted to the fixing unit 5, and computes a fixing electric power $P_{FIX}$ that is actually applied to the fixing unit 5 by multiplying the two values (steps S104 to S106).

The CPU 204 computes the electric power compensation value $P_{AD}$ based on the fixing electric power $P_{FIX}$ that is actually applied and the fixing-applied electric power $P_{IN}$ computed in step S102 (step S107). The CPU 204 uses the $P_{AD}$ computed here as a correction value at the next time of applying the electric power (step S102). The electric power compensation value $P_{AD}$ is a variable that amends an influence of a characteristic change of the induction heating coil due to a change of an environmental temperature, and is set so that the fixing-applied electric power $P_{IN}$ that is set is coincident with the fixing electric power $P_{FIX}$ that is actually applied. When the electric power compensation value $P_{AD}$ is always negligible, it is possible to delete steps S102 and S107 and to substitute the electric power computed in step S101 into the fixing-applied electric power $P_{IN}$.

Next, the electric power consumption of the image forming apparatus will be described.

(I) Method for Accumulating Maximum Electric Power Consumptions

Figure 4:
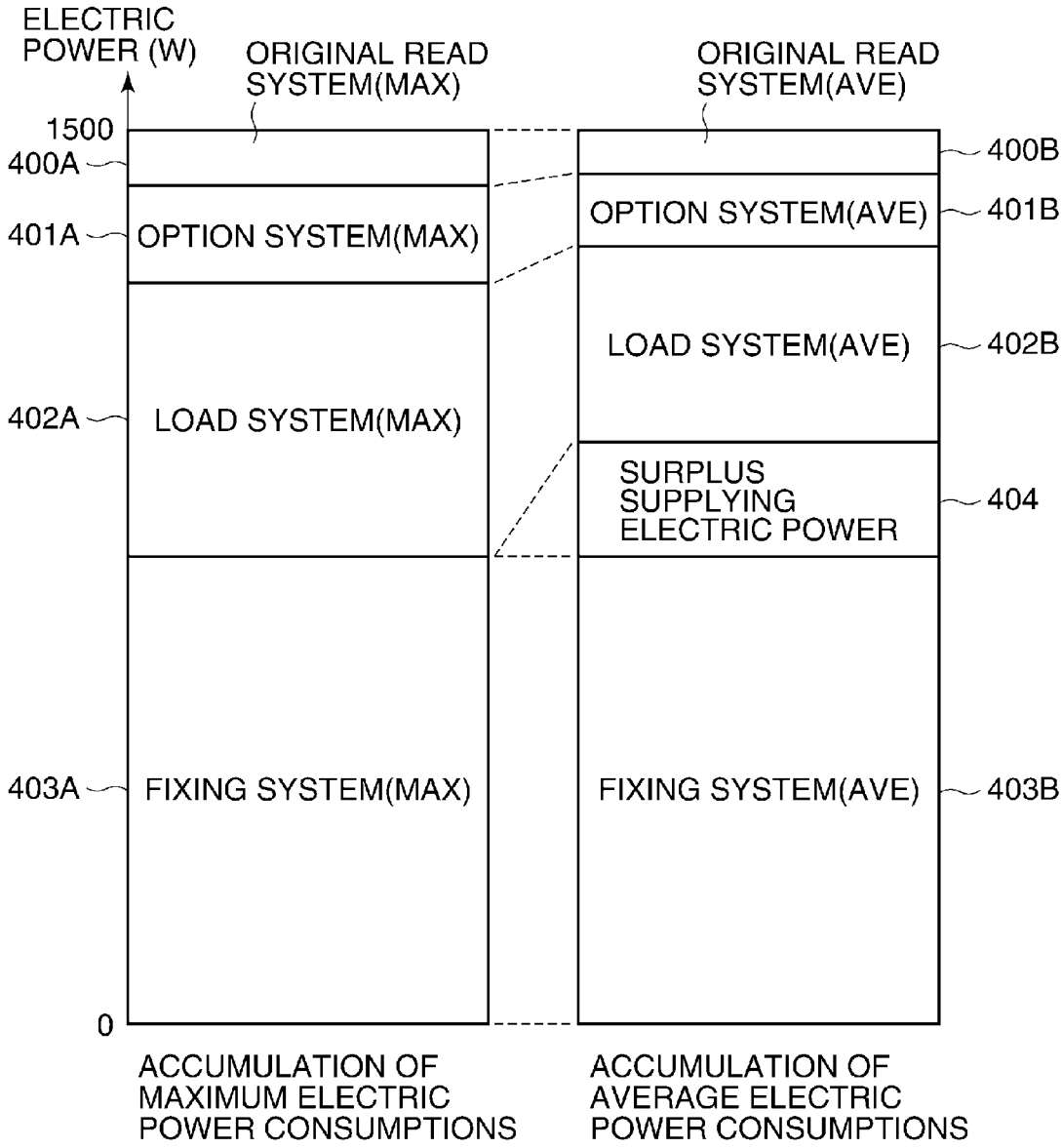
FIG. 4A and FIG. 4B are graphs showing electric power consumptions of a general image forming apparatus.

Here, the image forming apparatus that is connected to a commercial power source of 100V/15 A in Japan and used will be described as an example with reference to FIG. 4A and FIG. 4B. FIG. 4A and FIG. 4B are graphs showing electric power consumptions of a general image forming apparatus.

The electric power consumption of the entire apparatus will be classified into four groups as follows.

(1) Electric power consumption in an original read system including the reader unit, the ADF, etc.

(2) Electric power consumption in an option system including a sheet feeding device, a post processing device, etc.

(3) Electric power consumption in a load system including a paper conveyer, a control system, etc.

(4) Electric power consumption in the fixing system

Since a power supply capacity is limited to 1500 W, a power supply distribution is designed based on an accumulation of the maximum electric power consumptions of the respective loads so that the electric power consumption of the entire apparatus does not exceeds a limit value of 1500 W in any cases (FIG. 4A).

Figure 5:
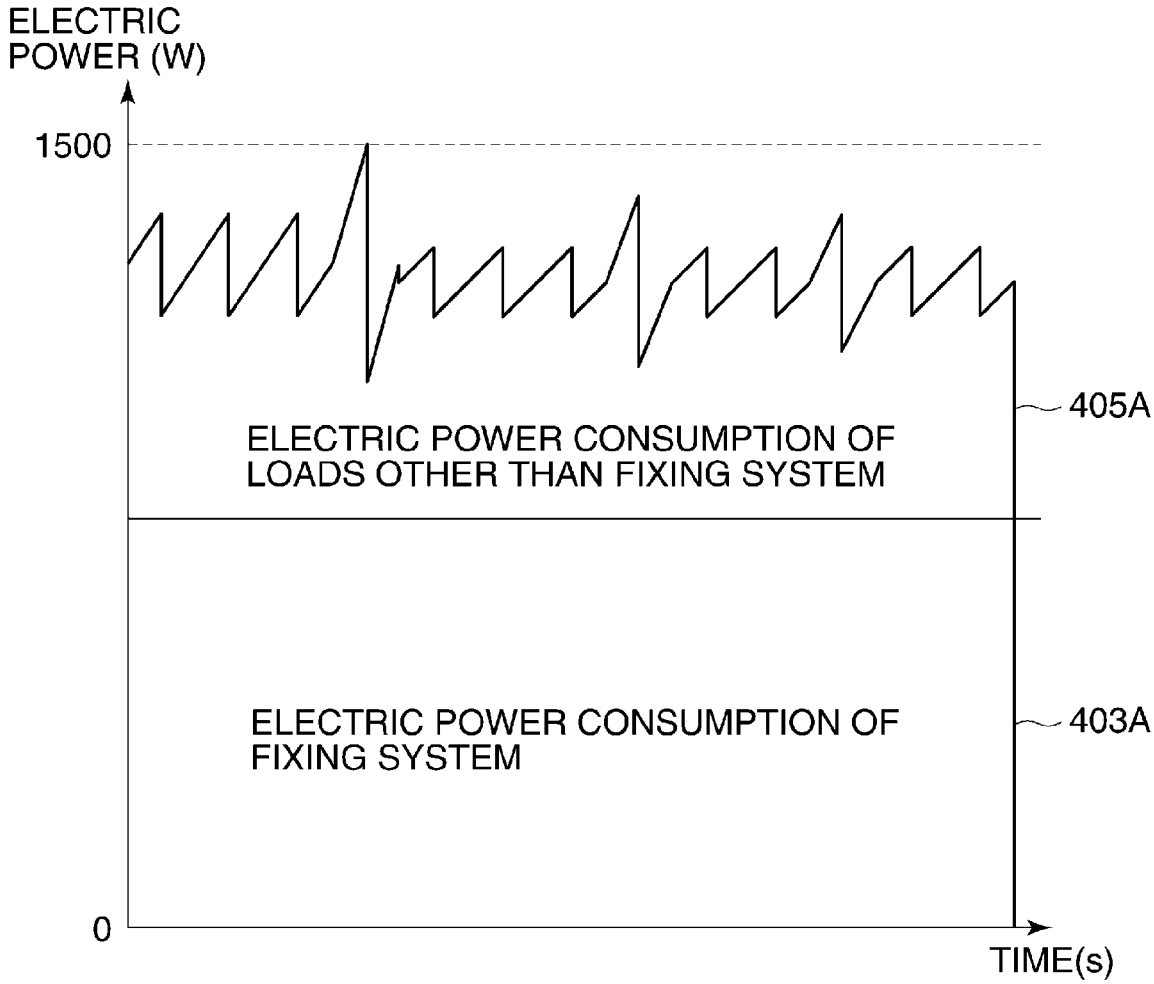
FIG. 5 is a graph showing electric power consumption of the general image forming apparatus during a print operation when estimating electric power consumption at the maximum.

For example, FIG. 5 is a graph showing a total electric power consumption waveform of the general image processing apparatus during a print operation.

The fixing unit 5 consumes the electric power (403A) required for the print operation by the fixing temperature control described above. The electric power consumption of the loads other than the above mentioned fixing unit 5 is accumulated thereon. The electric power consumption of the loads other than the fixing unit 5 repeatedly increase and decrease according to operating conditions such as drive/halt of a motor, lighting/shutting-off of the light source of the original read system (405A). Therefore, when the loads of the above described four groups operate with maximum electric power consumptions simultaneously, the electric power consumption comes to about 1500 W.

For example, in this example, if an original is not read when the option system device such as the post processing device operates, the electric power consumption does not come to 1500 W. In other words, in the method for accumulating the maximum electric power consumptions, although a power supply capability of the electric power source has surplus electric power in the time except when all the loads operate simultaneously, the surplus electric power is not used. Therefore, the electric power source is not used effectively.

(II) Method for Accumulating Average Electric Power Consumptions

Then, the maximum electric power consumption of the image forming apparatus 100 is considered as the accumulation of the average electric power consumptions instead of the maximum electric power consumptions of the respective loads (see FIG. 48).

When considering as the accumulation of the average electric power consumption, the average electric power consumption is smaller than the maximum electric power consumption for the systems that do not continuously operate such as the original read system, the option system, and the load system.

Therefore, the average of a surplus supplying electric power (404) is acquired by accumulating the average electric power consumptions. If the surplus supplying electric power is used as a fixing system electric power (403B), the quantity of heat given to the fixing unit 5 can increase, which enables to improve the speed of the image forming apparatus than the case where the method for accumulating the maximum electric power consumptions is used.

Figure 6:
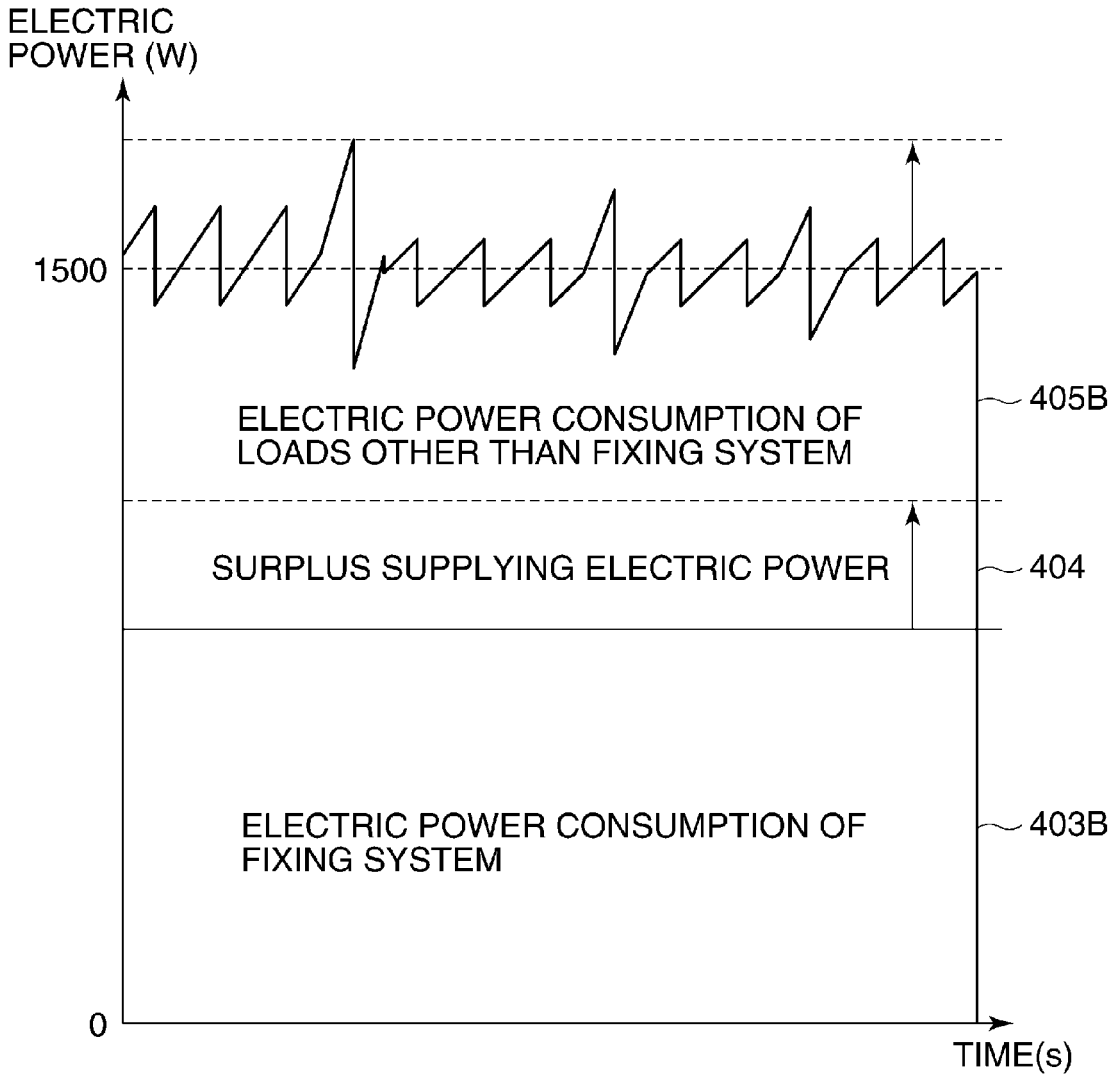
FIG. 6 is a graph showing electric power consumption of the general image forming apparatus during a print operation when estimating electric power consumption at an average.

Next, FIG. 6 is a graph schematically showing the total electric power consumption waveform of the general image forming apparatus during the print operation when estimating the above described average electric power consumption.

As shown in FIG. 6, since the electric power consumption is estimated by the average electric power consumption, an average value (404) of the surplus supplying electric power is added. However, since the electric power consumption is estimated by the average electric power consumption, the power consumption of the entire apparatus instantaneously exceeds 1500 W when the respective loads operate at the same time. In such a case, since the electric power consumption exceeds the power supply capacity, the apparatus may malfunction.

Therefore, a total electric current of the entire image forming apparatus 100 is detected by using the electric current sensor 203, and the electric power control is performed to fluctuate the electric power given to the fixing unit 5 based on the detection result (the total electric power control using the electric current sensor). This enables to become possible to restrict the total electric power consumption to 1500 W, even when the power consumption of the image forming apparatus 100 is estimated by the average value.

Next, the above mentioned total electric power control using the electric current sensor 203 will be described. Although the basic fixing temperature control is identical to the description in FIG. 3, information of the total electric current detected by the electric current sensor 203 is added to the control.

FIG. 7 is a flowchart showing the total electric power control using the electric current sensor 203 according to the embodiment.

The CPU 204 periodically acquires the fixing temperature $T_{FIX}$ detected with the thermistor 5*b* (step S200). The CPU 204 computes the electric power $P_{SET}$ that should be supplied to the fixing unit 5 based on the target fixing temperature and the acquired fixing temperature $T_{FIX}$ (step S201). Moreover, the CPU 204 computes the fixing-applied electric power $P_{IN}$ based on the sum of the electric power compensation value $P_{AD}$ and the fixing electric power $P_{SET}$ (step S202). As mentioned above, the $P_{AD}$ is zero at first.

Next, the CPU 204 computes a fixing allowable electric power $P_{MAX}$ that can be applied to the fixing unit 5 based on a total electric current $I_{TOTAL}$ detected by the electric current sensor 203 (step S203 and step S204). Specifically, the sum of the fixing-applied electric power $P_{IN}$ and the electric power corresponding to the difference between the maximum rated electric current and the detected total electric current becomes the fixing allowable electric power P. For example, when the maximum rated electric current is 15 A, the fixing-applied electric power $P_{IN}$ computed in step S202 is 800 W, the electric current value detected by the electric current sensor 203 is 10 A, and the voltage of an AC power supply is 100V, the fixing allowable electric power P becomes 1300 W, since the surplus supplying electric power becomes 500 W. And the CPU 204 compares the fixing-applied electric power $P_{IN}$ computed in step S202 and the fixing allowable electric power $P_{MAX}$ (step S205). Here, if the fixing-applied electric power $P_{IN}$ is not larger than the fixing allowable electric power $P_{MAX}$, the CPU 204 sends out the fixing control pulse to the fixing power supply circuit 205 from the fixing electric power control unit 204*a* based on the computed value (step S206). As a result, the electric power is applied to the fixing unit 5.

On the other hand, if the fixing-applied electric power $P_{IN}$ exceeds the fixing allowable electric power $P_{MAX}$, the total electric power consumption exceeds the limit value of 1500 W when the fixing-applied electric power $P_{IN}$ is applied without correction. Therefore, the CPU 204 replaces the fixing-applied electric power $P_{IN}$ with the fixing allowable electric power $P_{MAX}$, and applies the electric power to the fixing unit 5 (steps S206 and S207). That is, since the fixing allowable electric power $P_{MAX}$ that can be supplied to the fixing unit 5 is changed based on the total electric current value that is flowing into the entire apparatus, the necessary electric power can be applied without correction when the electric power that can be supplied has a margin. Conversely, when the fixing-applied electric power $P_{IN}$ is close to the maximum electric power, the total electric power consumption of the entire apparatus can be restricted to the limit value by limiting the fixing allowable electric power $P_{MAX}$.

Figure 8:
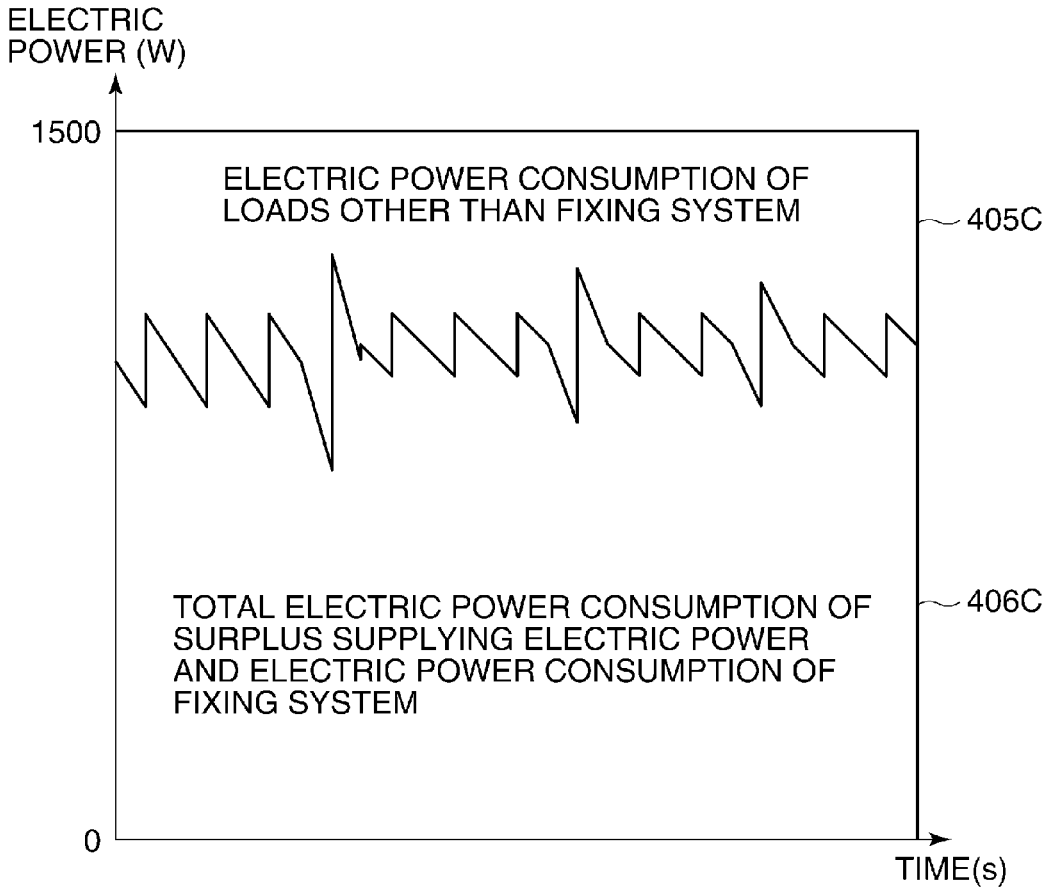
FIG. 8 is a graph schematically showing a total electric power consumption waveform of the image processing apparatus when performing the total electric power control according to the embodiment.

FIG. 8 is a graph schematically showing the total electric power consumption waveform of the image processing apparatus 100 when performing such a total electric power control using the electric current sensor 203.

As shown in FIG. 8, the fixing electric power (406C) fluctuates in connection with the fluctuation of the electric power consumption (405C) due to the operations of the loads other than the fixing system. This enables to control so that the total electric power consumption of the entire apparatus does not exceed the limit value of 1500 W. Further, when the electric power has a margin, the electric power can be used effectively by setting a large electric power supplied to the fixing unit 5.

In the case of a load such as a motor, since the restriction of the supplying electric power causes a malfunction, the above-mentioned electric power control cannot be performed. However, regarding the fixing unit, although there is apprehension that the decrease of the electric power lowers the fixing temperature, the fixing temperature does not fall regularly because it is instantaneous.

Next, a failure detection process for the electric current sensor 203 will be described.

When the electric current sensor 203 breaks down and outputs an abnormal electric current value, the apparatus causes a failure in the operation when controlling based on the improper detection value. For example, when the total electric current detected by the electric current sensor 203 is larger than the total electric current that flows actually (for example, when 10 A is improperly detected as 15 A), the fixing-applied electric power is restricted even though the actual electric power has a margin. Therefore, since the temperature of the fixing unit falls, there is apprehension of the quality degradation of the image due to an insufficient fixing of the development agent etc.

Conversely, when the total electric current detected by the electric current sensor 203 is smaller than the total electric current that flows actually (for example, when 15 A is improperly detected as 10 A), the fixing-applied electric power is not restricted even though the actual electric power has already reached 15 A. Therefore, the problem that the image forming apparatus stops may occur when a breaker of the image forming apparatus operates due to overheat of the fixing unit or an over electric current.

In order to avoid the problem during an operation of the apparatus caused by a failure of the electric current sensor, the following failure detection processes is executed in this embodiment.

In order to detect a failure, the load whose electric power consumption is known in the image forming apparatus is energized. When the detected value of the electric current sensor 203 at that time is out of the predetermined range, it is determined that a failure occurs. Here, a drum heater that adjusts the temperature of the photoconductive drum 1 is used as the load, for example. Any device inside the apparatus can be used as the load that is used for the failure detection process. However, a load using a halogen heater such as the drum heater through which a constant electric current flows when it is energized is preferable than a load like a motor whose electric current consumption fluctuates with sizes of gears or rollers driven thereby.

Figure 9:
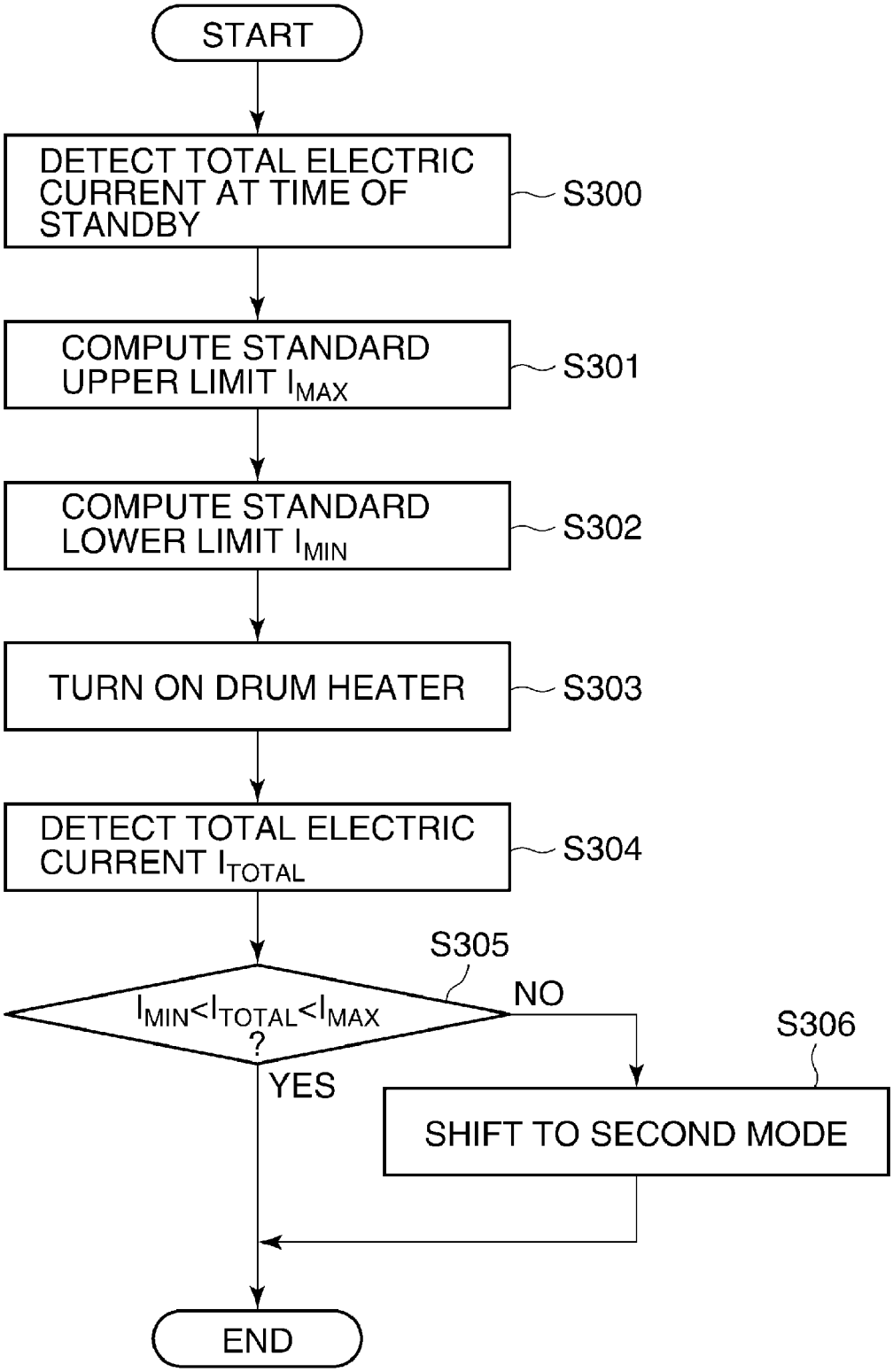
FIG. 9 is a flowchart showing a failure detection process for the electric current sensor according to the embodiment.
Figure 10:
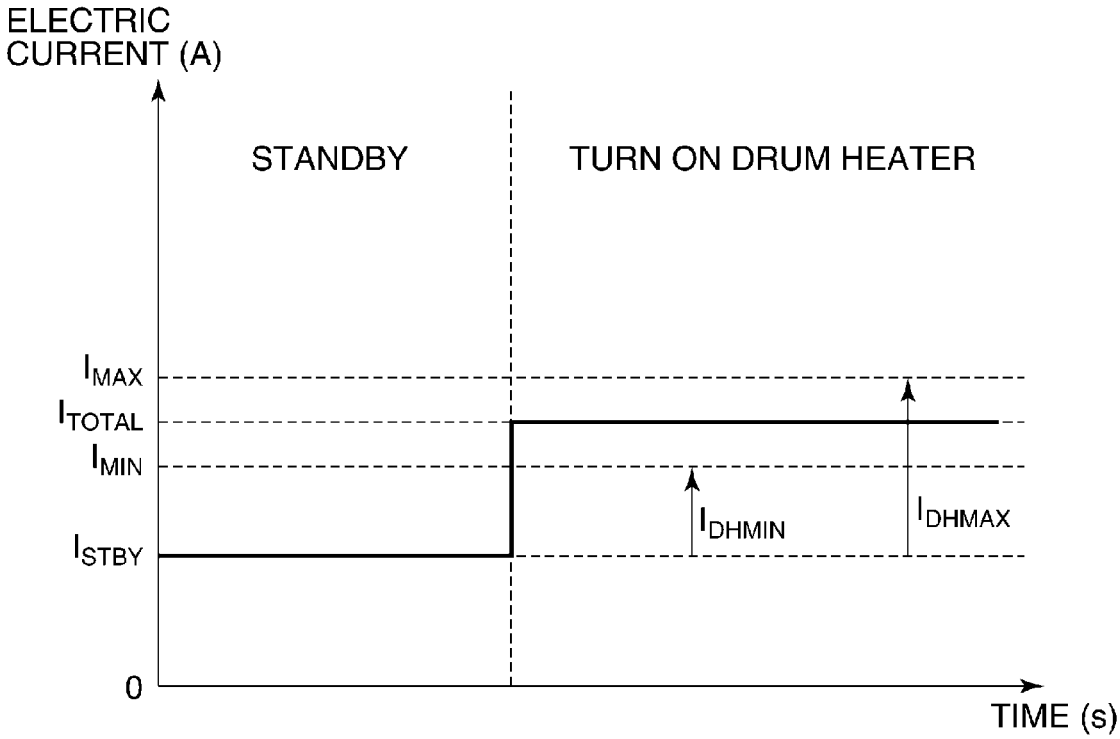
FIG. 10 is a waveform diagram showing an electric current waveform when the failure detection process for the electric current sensor is executed.

FIG. 9 is a flowchart showing the failure detection process for the electric current sensor 203 according to the embodiment, and FIG. 10 is a waveform chart showing the electric current waveform at the time of execution of the failure detection process for the electric current sensor.

The CPU 204 detects a total electric current $I_{STBY}$ at the time of standby of the image forming apparatus 100 by the electric current sensor 203 first (step S300). Next, the CPU 204 computes a standard upper limit $I_{MAX}$ ($=I_{STBY}+I_{DHMAX}$) for the failure detection by adding the maximum value $I_{DHMAX}$ of the electric current flowing into the drum heater to the total electric current $I_{STBY}$ (step S301). Further, the CPU 204 computes a standard lower limit $I_{MIN}$($=I_{STBY}+I_{DHMIN}$) for the failure detection by adding the minimum value $I_{DHMIN}$ of the electric current flowing into the drum heater to the total electric current $I_{STBY}$ (step S302).

The electric current values $I_{DHMAX}$ and $I_{DHMIN}$ that flow into the drum heater are known values that are inputted during an assembling of the image forming apparatus 100 etc., and are stored in a ROM installed inside or outside of the CPU 204.

Next, the CPU 204 makes the drum heater turn on (step S303), and detects the total electric current $I_{TOTAL}$ of the image forming apparatus 100 at that time (step S304). The CPU 204 determines whether the total electric current $I_{TOTAL}$ falls within the range between $I_{MAX}$ and $I_{MIN}$ (a range of standard) (step S305).

If the total electric current $I_{TOTAL}$ detected here falls within the range of standard, the CPU 204 determines that the electric current sensor 203 is normal, and continues the control (a first mode) using the electric current sensor 203 (YES of step S305). On the other hand, if the total electric current $I_{TOTAL}$ detected is out of the range of standard, the CPU 204 determines that the electric current sensor 203 is abnormal, and changes the mode from the first mode to the second mode (step S306).

The second mode will be described here. When the failure of the electric current sensor 203 is detected, the mode is shifted to the second mode. Therefore, the total electric power control using the electric current sensor 203 cannot be performed in the second mode. In this case, if the apparatus is operated in the first mode, since the function to restrict the total electric power consumption will not work, the electric power consumption exceeds the limit value of 1500 W of the power supply capacity as shown by the waveform in FIG. 6.

Thus, the operation mode is shifted from the first mode in which the surplus supplying electric power is used as the fixing electric power as shown in FIG. 43 to the second mode as shown in FIG. 4A. That is, in the second mode, the fixing-applied electric power is set as being lower than the electric power that is acquired by subtracting the maximum electric power of the loads other than the fixing unit 5 from the electric power limit value of 1500 W, without using the surplus supplying electric power that was used as the electric power that can be applied to the fixing unit 5. In this case, since the electric power that can be applied to the fixing unit decreases, the print speed of the apparatus becomes lower than in the first mode. However, since the improper electric power is not supplied to the apparatus, the operation of the apparatus is not stopped, which can avoid that the down time becomes long.

According to the embodiment, there are the following advantages.

1. Since the fixing electric power applied to the fixing unit 5 is controlled based on the total electric current of the image forming apparatus 100 that is detected by the electric current sensor 203, the electric power can be supplied efficiently while keeping the total electric power consumption of the image forming apparatus 100 as being lower than the predetermined value (see FIG. 7).

2. Since the mode corresponding to the failure of the electric current sensor 203 is provided, when the failure of the electric current sensor 203 is detected, a runaway operation of the image forming apparatus caused by the total electric power control based on an improper electric current value can be prevented.

3. When the failure of the electric current sensor 203 is detected, the mode is changed to the second mode, and the print operation can be continued even if the electric current sensor 203 breaks down.

Other Embodiments

Aspects of the present invention can also be realized by a computer of a system or apparatus (or devices such as) a CPU or MPU) that reads out and executes a program recorded on a memory device to perform the functions of the above described embodiment, and by a method, and the steps of which are performed by a computer of a system or apparatus by, for example, and reading out and executing a program recorded on a memory device to perform the functions of the above described embodiment. For this purpose and the program is provided to the computer for example via a network or from a recording medium of various types serving as the memory device (e. g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-274172, filed on Oct. 24, 2008, and which is hereby incorporated by reference herein in its entirety.

What is claimed is:

1. An image forming apparatus that operates by an electric power from a commercial power source, comprising:

a fixing unit adapted to fix a developed image transferred to sheet material;

a temperature detection unit adapted to detect a temperature of said fixing unit;

a control unit adapted to determine a fixing electric power supplied to said fixing unit based on the temperature detected by said temperature detection unit;

an electric current detection unit adapted to detect an electric current flowing into the image forming apparatus from the commercial power source; and a failure detection unit adapted to determine whether said electric current detection unit breaks down, wherein said control unit determines the fixing electric power so that the electric power consumption determined based on the electric current detected by said electric current detection unit does not exceed a limit value, and wherein said control unit determines the fixing electric power so as not to exceed a predetermined electric power without using the output of said electric current detection unit when said failure detection unit determines that said electric current detection unit breaks down.

2. The image forming apparatus according to claim 1, wherein the predetermined electric power is the electric power that is acquired by subtracting the maximum electric power consumption of loads other than said fixing unit from the limit value.

3. The image forming apparatus according to claim 1, wherein said failure detection unit determines that said electric current detection unit breaks down when the electric current value detected by said electric current detection unit is out of a predetermined range under the condition where a predetermined load is energized.

4. The image forming apparatus according to claim 3, wherein the predetermined range is defined within a specified range from the electric current value detected by said electric current detection unit when the predetermined load is not energized.

5. A control method for an image forming apparatus that has a fixing unit for fixing a developed image transferred to sheet material, an electric current detection unit for detecting an electric current flowing into the image forming apparatus from a commercial power source, a temperature detection unit for detecting a temperature of the fixing unit, and a control unit for controlling a fixing electric power supplied to the fixing unit, the method comprising:

a first determination step of determining the fixing electric power supplied to the fixing unit based on the temperature of the fixing unit detected by the temperature detection unit;

a changing step of changing the fixing electric power determined in said first determination step so that the electric power consumption determined based on the electric current detected by the electric current detection unit does not exceed a limit value;

a failure detection step of determining whether the electric current detection unit breaks down;

a second determination step of prohibiting the execution of said changing step, and of determining the fixing electric power so that the fixing electric power does not exceed a predetermined electric power that is lower than the limit value when it is determined that the electric current detection unit breaks down in the failure detection step.

* * * * *